US006202791B1

(12) United States Patent
Oh et al.

(10) Patent No.: US 6,202,791 B1
(45) Date of Patent: Mar. 20, 2001

(54) OIL CIRCULATION STRUCTURE FOR LINEAR COMPRESSOR AND METHOD OF THE SAME

(75) Inventors: Won Sik Oh, Seoul; Hyeong Kook Lee, Kunpo; Gye Young Song, Kwangmyung, all of (KR)

(73) Assignee: LG Electronics, Inc. (KR)

( * ) Notice: Subject to any disclaimer, the term of this patent is extended or adjusted under 35 U.S.C. 154(b) by 0 days.

(21) Appl. No.: 09/313,925

(22) Filed: May 18, 1999

(30) Foreign Application Priority Data

May 18, 1998 (KR) ..... 98-17869
Oct. 23, 1998 (KR) ..... 98-44528

(51) Int. Cl.[7] ..... F04B 17/04; F01C 1/04
(52) U.S. Cl. ..... 184/6.16; 184/6.22; 417/417
(58) Field of Search ..... 184/6.16, 6.22; 417/417

(56) References Cited

U.S. PATENT DOCUMENTS 3,630,316 * 12/1971 Sillano ..... 184/6.16
3,685,617 * 8/1972 Gardner ..... 184/6.16
4,624,629 * 11/1986 Murayama et al. ..... 184/6.16
4,710,111 * 12/1987 Kubo ..... 184/6.16
5,012,896 * 5/1991 Da Costa ..... 184/6.16
5,224,845 * 7/1993 Mangyo et al. ..... 184/6.16
5,330,335 * 7/1994 Terauchi et al. ..... 184/6.16
5,358,392 * 10/1994 Ukai ..... 184/6.16
5,421,709 * 6/1995 Hill et al. ..... 184/6.16
5,678,657 * 10/1997 Lee ..... 184/6.16
5,678,986 * 10/1997 Terauchi et al. ..... 184/6.16
6,089,352 * 7/2000 Kim et al. ..... 184/6.16
6,089,836 * 7/2000 Seo ..... 417/417

* cited by examiner

*Primary Examiner*—David A. Bucci
*Assistant Examiner*—Chong H. Kim
(74) *Attorney, Agent, or Firm*—Ostrolenk, Faber, Gerb & Soffen, LLP

(57) ABSTRACT

An oil circulation structure for a linear compressor and a method of the same are disclosed. The oil circulation structure includes an exhaust portion oil circulation path in which an oil is circulated at an exhaust portion at which a gas compression and exhausting operation is performed, for thereby cooling the exhaust portion, a cylinder cooling oil circulation path communicating with one side of the exhaust portion oil circulation path for cooling an outer surface of the cylinder, a friction portion cooling oil circulation path for cooling a friction portion between the cylinder and the piston, a plurality of oil through holes formed at the cylinder for communicating the cylinder cooling oil circulation path with the friction portion cooling oil circulation path, an oil supply path for supplying the oil pumped from the oil supply unit into the cylinder cooling oil circulation path, and an oil exhaust hole formed at the frame and communicating another side of the exhaust portion oil circulation path for thereby returning the oil into the hermetic container, for thereby increasing a cooling effect of a cylinder and exhaust portion and a lubricating performance of a friction portion, enhancing the efficiency of a compressor, and decreasing an oil flowing noise for thereby enhancing a reliability of the product.

11 Claims, 10 Drawing Sheets

OIL CIRCULATION STRUCTURE FOR LINEAR COMPRESSOR AND METHOD OF THE SAME

BACKGROUND OF THE INVENTION

1. Field of the Invention

The present invention relates to a linear compressor, and in particular to an oil circulation structure for a linear compressor and a method of the same which are capable of increasing a cooling effect by supplying an oil to a cylinder and exhaust portion and implementing an excellent lubrication performance at a friction portion for thereby enhancing an efficiency of a compressor and increasing a reliability of the product.

2. Description of the Background Art

A high efficiency and power conserving feature is a new trend in a home appliance such as a refrigerator, an air conditioner, etc. The technology for a compressor which forms a freezing cycle apparatus for a refrigerator, an air conditioner, etc. has been intensively developed.

As shown in FIG. 1, the construction of a conventional linear compressor will be explained.

FIG. 1 is a vertical cross-sectional view illustrating an example of a conventional linear compressor. The linear compressor includes a compressor unit 90 horizontally installed in the interior of a hermetic container 1 for sucking, compressing and exhausting a refrigerant gas, and an oil supply unit 10 installed at a lower portion of the compressor unit 90 for supplying an oil at the inner lower surface into the interior of the compressor unit 90.

The compressor unit 90 includes a hollow cylindrical frame 20, a hollow cylindrical cylinder 30 engaged to a portion of the frame 20, an outer lamination 40 and a coil assembly 40*a* engaged to an inner surface of the frame 20, an inner lamination 50 engaged to an outer portion of the cylinder at a certain interval from the outer lamination 40, a piston(70) integrally formed with a rotator 60 which linearly reciprocates between the outer lamination 40 and the inner lamination 50 and installed in the interior of the cylinder 20, a hallow cylindrical cover 80 engaged at the other end of the frame 20, and a valve cover 3 including a valve assembly 2 therein for covering an end portion of the cylinder 30.

The structure that an oil is supplied to the compressor unit 90 by the oil supply unit 10 and is exhausted therefrom will be explained with reference to FIG. 2.

First, an oil supply pocket 31*a* is formed at a lower portion contacting with the frame 20 and the cylinder 30 and communicates with an oil suction path 11 through which an oil is sucked from the oil supply unit 10. An oil exhaust pocket 31*b* is formed at an upper portion and communicates with an oil exhaust hole(not shown) formed to exhaust the oil in the direction of one side of the frame 20.

In addition, oil paths 32*a* and 32*b* are formed at a certain inclination angle to flow an oil up to the inner surface of the cylinder 30 via the oil supply and exhaust pockets 31*a* and 31*b*, namely, up to the contact portions of the cylinder 30 and the piston 70. An oil pocket 75 is formed at the inner ends of the oil paths 32*a* and 32*b*, namely, at the friction portion of the piston 70 and the cylinder 30. The oil pocket 75 of the friction portion is formed on an outer surface of the piston 70 and has a certain width and groove over the entire surfaces.

In the drawings, reference numeral 4 represents a refrigerant suction tube, 24 and 25 represent coil springs elastically supported between the cylinder 30 and the piston 70, and the piston 70 and the cover 80.

The oil circulation operation of the conventional linear compressor having an oil circulation structure will be explained.

When a power is applied to the compressor unit 90, the rotator 60 reciprocates between the outer lamination 49 and the inner lamination 50. Therefore, the piston 70 reciprocates in the cylinder 30. The refrigerant gas flown into the hermetic container 1 is sucked into a compression chamber of the cylinder 30 via the refrigerant flow path formed at a center portion of the piston 70 and is compressed therein, and then is exhausted via the exhaust valve assembly 2 and the exhaust cover 3. The above-described operation is repeatedly performed.

In the oil supply and exhaust process in which the operation of the compressor unit 90 is performed, the oil supply unit 10 is vibrated together with the compressor unit 90 and suck an oil. The thusly sucked oil is pumped along the oil suction path 11 and is flown into the friction portion oil pocket 75 via the oil supply pocket 31*a* and the oil introduction oil path 32*a*. The thusly introduced oil lubricates and cools the friction portion between the cylinder 30 and the piston 70 and is exhausted to the outside of the compressor unit 90 sequentially via the oil exhaust path 32*b*, the oil exhaust pocket 31*b* and the oil exhaust hole(not shown).

In other words, as shown in FIG. 3, in the conventional oil circulation process, the oil supply unit 10 performs an oil pumping step for pumping an oil from the inner bottom surface of the hermetic container 1, and in the friction portion oil supply step, the thusly pumped oil lubricates and cools the friction portion between the cylinder 30 and the piston 70. In addition, an oil returning step, the oil passed through the friction portion oil supply step returns to the inner bottom surface of the hermetic container 1 via an oil exhaust hole(not shown) of the frame 20.

In the thusly constituted conventional linear compressor having the oil circulation structure, the oil supplied from the oil supply unit 10 flows through the introduction oil path 32*a* of the cylinder 30 and is introduced into the friction portion of the cylinder 30 and the piston 70. After a certain lubricating process therein, the oil is flown via the exhaust oil path 32*b* of the cylinder 30 and is exhausted to the outside of the compressor unit 90. Therefore, the oil lubricates the friction portion of the cylinder 30 and the piston 70 and cools the piston 70.

However, in the conventional oil circulation structure for a conventional linear compressor, the exhaust valve assembly and valve cover which are heated by an exhaust gas are not effectively cooled. In addition, an effective cooling operation is not performed with respect to the cylinder, so that a re-expansion loss occurs due to the heating of the suction gas for thereby decreasing the efficiency of the compressor.

SUMMARY OF THE INVENTION

Accordingly, it is an object of the present invention to provide an oil circulation structure for a linear compressor and a method of the same which are capable of increasing a cooling effect of a cylinder and exhaust portion and a lubricating performance of a friction portion, enhancing the efficiency of a compressor, and decreasing the noise caused due to an oil flow for thereby enhancing a reliability of the product.

In order to achieve the above object, there is provided an oil circulation structure for a linear compressor which includes an exhaust portion oil circulation path in which an oil is circulated at an exhaust portion at which a gas compression and exhausting operation is performed, for thereby cooling the exhaust portion, a cylinder cooling oil circulation path communicating with one side of the exhaust portion oil circulation path for cooling an outer surface of the cylinder, a friction portion cooling oil circulation path for cooling a friction portion between the cylinder and the piston, a plurality of oil through holes formed at the cylinder for communicating the cylinder cooling oil circulation path with the friction portion cooling oil circulation path, an oil supply path for supplying the oil pumped from the oil supply unit into the cylinder cooling oil circulation path, and an oil exhaust hole formed at the frame and communicating another side of the exhaust portion oil circulation path for thereby returning the oil into the hermetic container.

In order to achieve the above object, there is provided an oil circulation method for a linear compressor which includes an oil pumping step for pumping an oil gathered on a bottom surface of a hermetic container by the oil supply unit, a friction portion oil supply step for lubricating and cooling the friction portion when the oil pumped in the oil pumping step is flown to the friction portion between the cylinder and the piston, an exhaust portion cooling step for cooling the exhaust portion when the oil lubricated and cooled the friction portion is flown to the side of the exhaust portion through which the gas is exhausted, and an oil returning step for returning the oil to the bottom surface of the hermetic container after the exhaust portion cooling step.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The oil circulation structure for a linear compressor and a method of the same according to the present invention will be explained with reference to the accompanying drawings.

Figure 1:
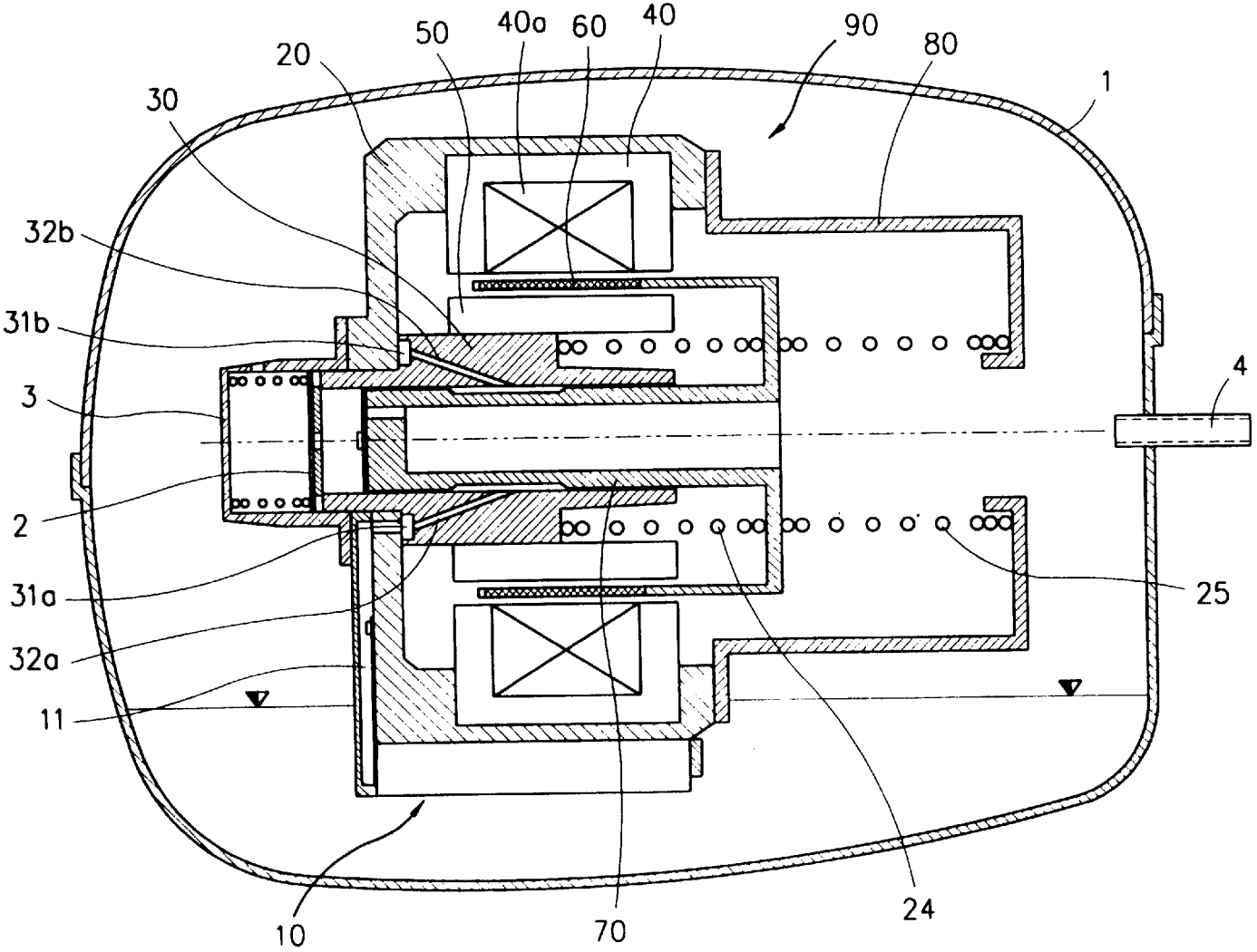
FIG. 1 CONVENTIONAL ART
FIG. 1 is a vertical cross-sectional view illustrating an example of a conventional linear compressor.
Figure 2:
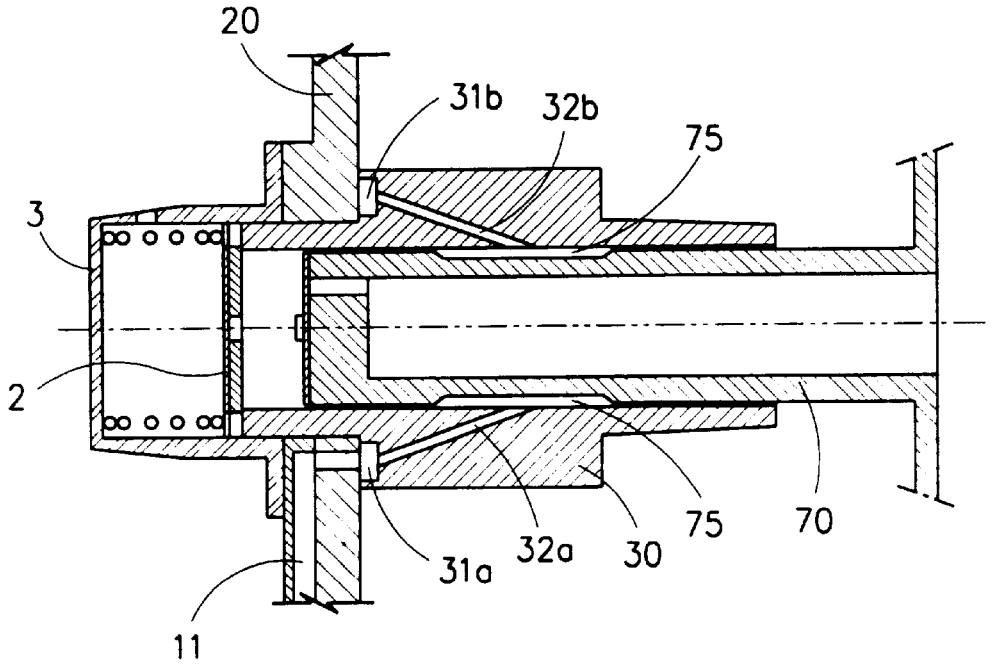
FIG.2 CONVENTIONAL ART
FIG. 2 is a partial vertical cross-sectional view illustrating a linear compressor having a conventional oil circulation structure.
Figure 3:
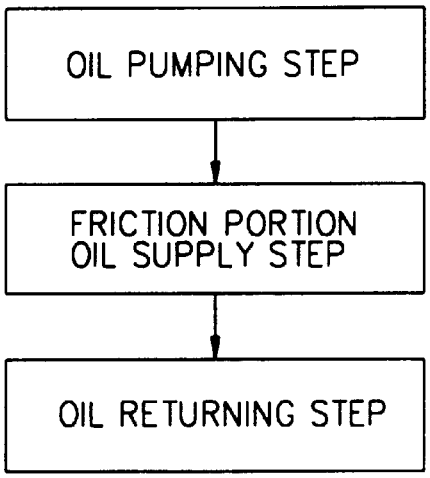
FIG.3 CONVENTIONAL ART
FIG. 3 is a flow chart illustrating an oil circulation process for a conventional linear compressor.
Figure 4:
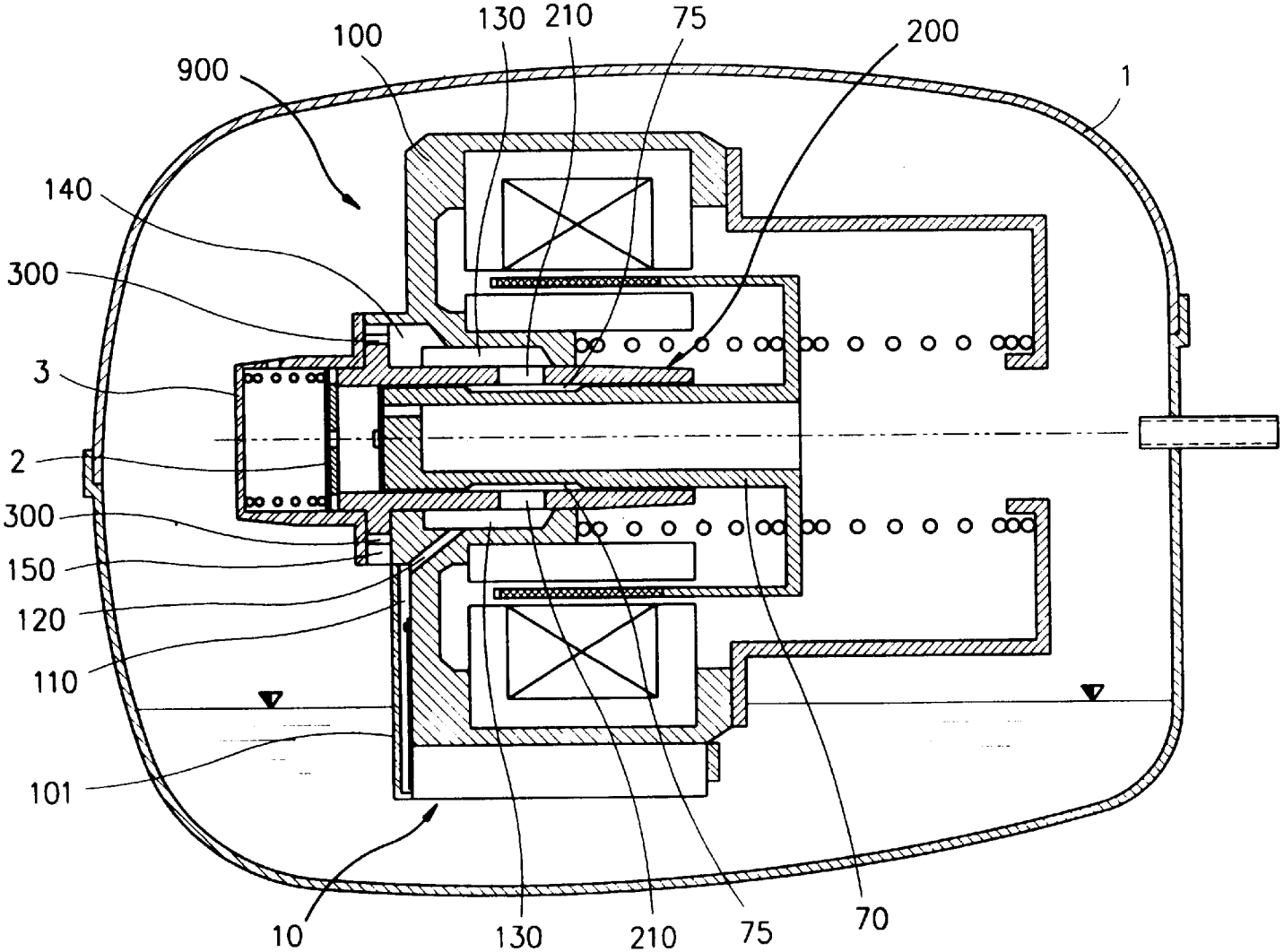
FIG. 4 is a partial cross-sectional view illustrating a linear compressor having an oil circulation structure according to a first embodiment of the present invention.
Figure 5:
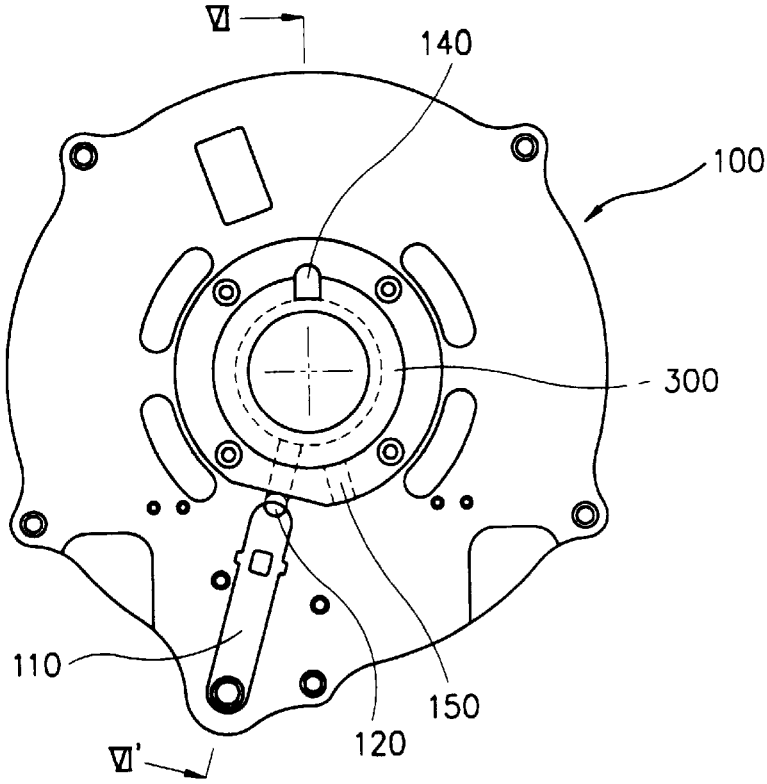
FIG. 5 is a front view illustrating a frame having an oil circulation structure according to a first-embodiment of the present invention.
Figure 6:
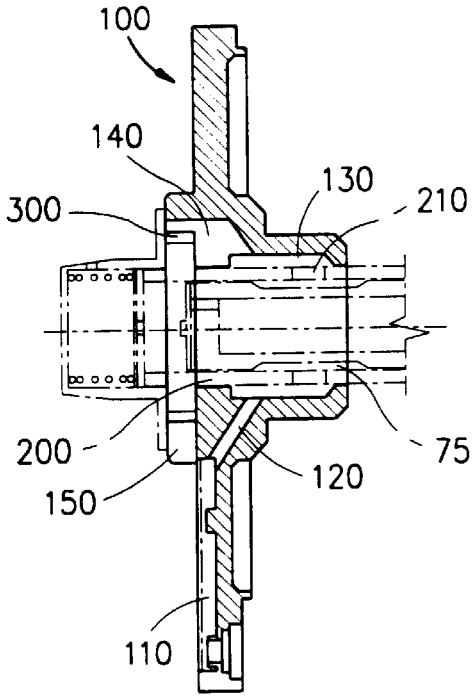
FIG. 6 is a cross-sectional view taken along line VI–VI' of FIG. 5.

FIG. 4 is a partial cross-sectional view illustrating a linear compressor having an oil circulation structure according to a first embodiment of the present invention, FIG. 5 is a front view illustrating a frame having an oil circulation structure according to a first embodiment of the present invention, and FIG. 6 is a cross-sectional view taken along line VI–VI' of FIG. 5.

The linear compressor according to the present invention includes a compressor unit 900 horizontally installed in the interior of a hermetic container 1 and having a hollow cylindrical frame 100, cylinder 200 and piston 70 for sucking and exhausting a refrigerant gas, and an oil supply unit 10 for supplying an oil into the interior of the compression unit 900. The above-described construction is the same as the conventional art. Therefore, the description thereof will be omitted except for an oil circulation structure formed at the compressor unit 900 and a method of the same. The same elements as the conventional art are given the same reference numeral.

In the first embodiment of the present invention, an oil suction path 110 is covered by a cover 101 at one surface of the hollow cylindrical frame 100 for sucking an oil from the oil supply unit 10, and an oil introduction path 120 communicates with the oil suction path 110 and is formed in the hole-formed direction of the frame 100 at a certain angle. A cylinder cooling oil pocket 130 is formed on a hollow surface of the frame 100 engaged with the cylinder 200 and has a certain width and depth, so that an oil flown from the oil suction path 110 and the oil introduction path 120 circulates on the entire outer surface of the cylinder 200.

A friction portion lubricating oil pocket 75 is formed on an entire outer surface of the piston 70 engaged with the cylinder 200 and has a certain width and depth. A plurality of oil through holes 210 are formed on the cylinder 200, so that the friction portion lubricating oil pocket 75 communicates with the cylinder cooling oil pocket 130.

At this time, the cylinder cooling lubrication pocket 130 may be formed on an outer surface of the cylinder 200, not on a hollow outer surface of the frame 100.

When inserting the cylinder 200 into the hollow portion of the frame 100, a ring groove shape exhaust portion oil circulation path 300 is formed at an end portion due to a diameter difference between an inner diameter of the frame 100 and an outer diameter of the cylinder 200. An open portion of the exhaust portion oil circulation path 300 is hermetically covered by the exhaust cover 2 and communicates with the cylinder cooling oil pocket 130 by a communication path 140 formed at a portion of the frame 100.

An exhaust hole 150 communicates with the exhaust portion oil circulation path 300 and is formed at an end portion of the frame so that the oil circulated in the exhaust portion oil circulation path 300 is exhausted to the inner bottom surface of the hermetic container 1.

The oil circulation operation of the linear compressor having an oil circulation structure according to a first embodiment of the present invention will be explained with reference to FIG. 7.

Figure 7:
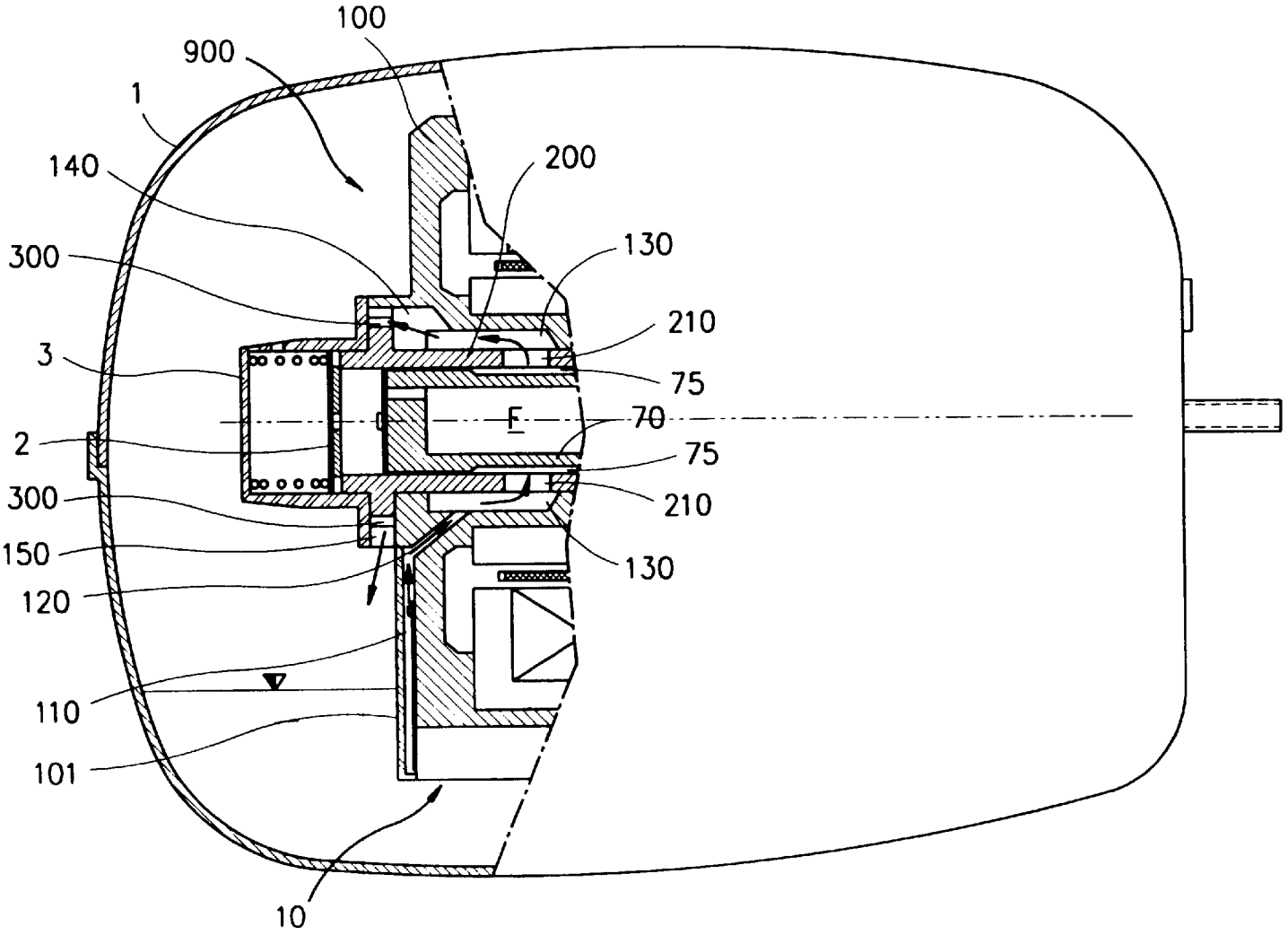
FIG. 7 is a view illustrating an oil circulation based on an oil circulation structure for a linear compressor according to a first embodiment of the present invention.

FIG. 7 is a flow chart illustrating an oil circulation process according to the present invention. As shown therein, in the oil supply unit 10, when pumping the oil from the inner bottom surface of the hermetic container 1 based on the vibration which occurs during a gas suction process when the piston 70 reciprocates, the thusly pumped oil is flown into the cylinder cooling oil pocket 130 via the oil suction path 110 and the introduction path 120 and circulates therein for thereby cooling the heat generated a the cylinder 200 and the compressor unit 900. A part of the oil flows via the oil through hole 210 formed at the cylinder 200 and is introduced into the friction portion lubricating oil pocket 75 for thereby implementing a lubricating operation between the piston 70 and the cylinder 200.

The oil from the cylinder cooling oil pocket 130 and the friction lubricating oil pocket 75 is flown into the exhaust portion oil circulation path 300 via the communication path 140. The thusly introduced oil circulates along the exhaust portion oil circulation path 300 and cools the valve cover 2 and the valve assembly 3 heated by the exhausting refrigerant gas and returns to the inner bottom surface of the hermetic container 1 via the exhaust hole 150. The thusly circulated oil is recirculated.

Figure 8:
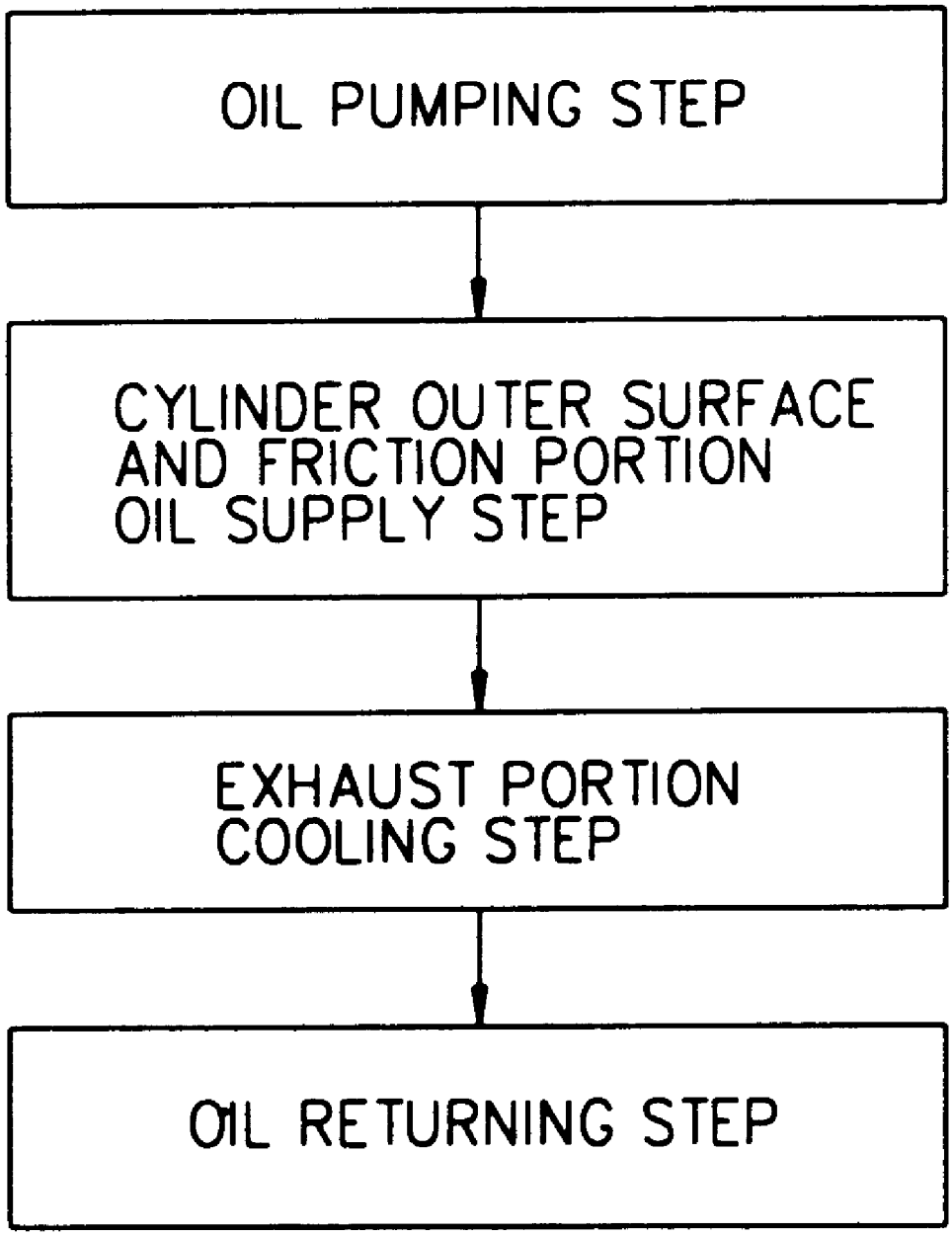
FIG. 8 is a flow chart illustrating an oil circulation process of a linear compressor according to a first embodiment of the present invention.

In other words, as shown in FIG. 8, in the oil circulation process according to the first embodiment of the present invention, an oil pumping step in which the oil is pumped from the inner bottom surface of the hermetic container 1 is performed in the oil supply unit 10, and a cylinder outer surface and friction portion oil supply step in which the oil after the oil pumping step cools the outer surface of the cylinder 200 and lubricates and cools the friction portion of the cylinder 200 and the piston 70, is performed.

Continuously, an exhaust portion cooling step in which the oil flown through the cylinder outer surface and friction portion oil supply step is supplied to the exhaust portion through which a gas is exhausted and cools the exhaust portion along the oil circulation path 300, and an oil returning step in which the oil which cooled the exhaust portion is returned to the inner bottom surface of the hermetic container 1, is performed.

As described above, in the oil circulation structure according to a first embodiment of the present invention, the oil supplied by the oil supply unit 10 circulates along the outer surface of the cylinder 200 for thereby firstly cooling the heat generated at the cylinder 200 and the compressor unit 900, and a part of the oil is supplied to the friction portion of the piston 70 and the cylinder 200 for lubricating the friction portion and cooling the heat occurring at the friction portion, so that the oil secondarily cools the heat generated at the exhaust portion which is formed of an end portion of the cylinder 200, the exhaust cover 2, etc. and through which the compressed gas is exhausted.

The linear compressor having an oil circulation structure according to a second embodiment of the present invention will be explained with reference to the accompanying drawing.

Figure 9:
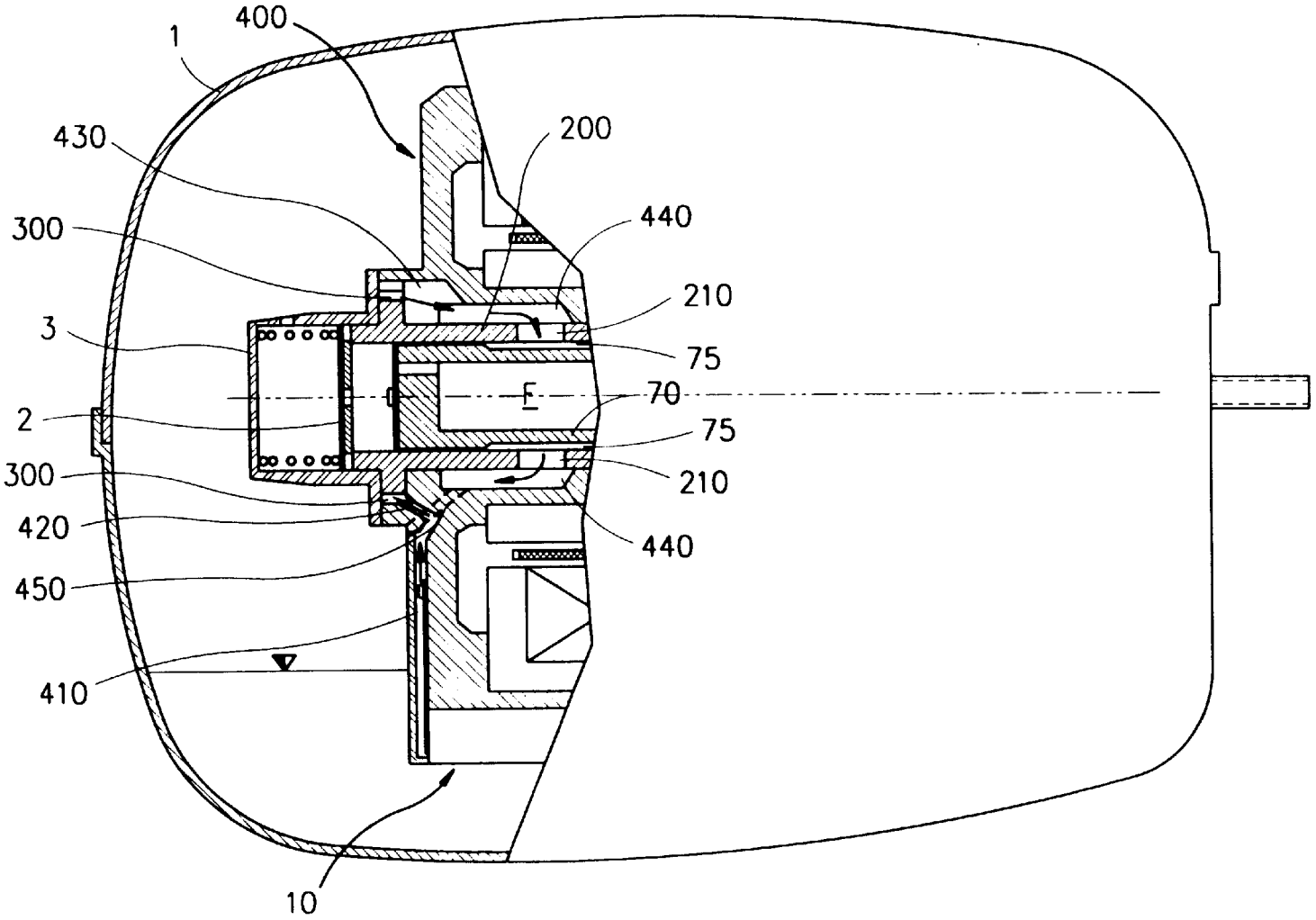
FIG. 9 is a partial cross-sectional view illustrating an oil circulation structure for a linear compressor according to a second embodiment of the present invention.
Figure 10:
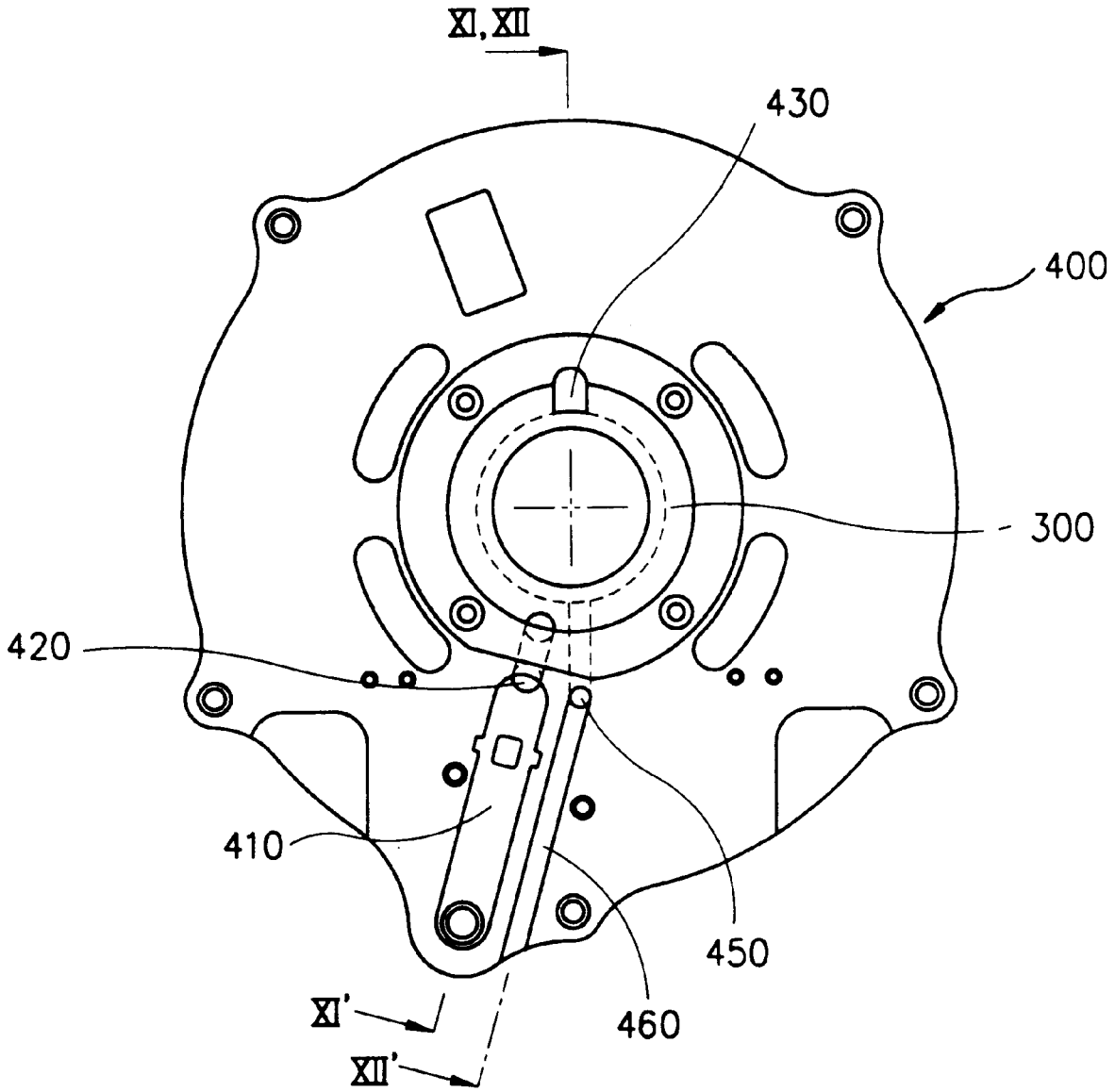
FIG. 10 is a front view illustrating a frame having an oil circulation structure according to a second embodiment of the present invention.
Figure 11:
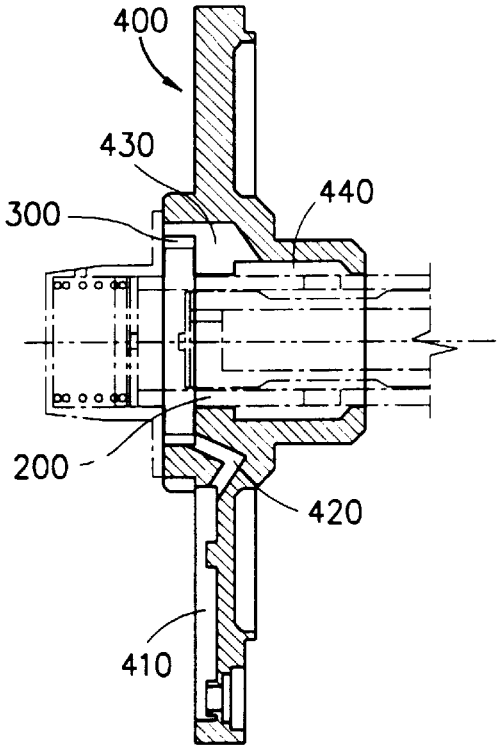
FIG. 11 is a cross-sectional view taken along line XI–XI' of FIG. 10.
Figure 12:
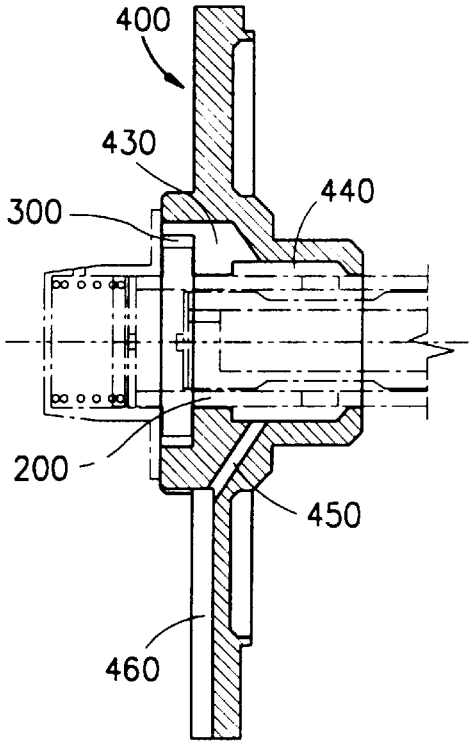
FIG. 12 is a cross-sectional view taken along line XII–XII' of FIG. 10.
Figure 13:
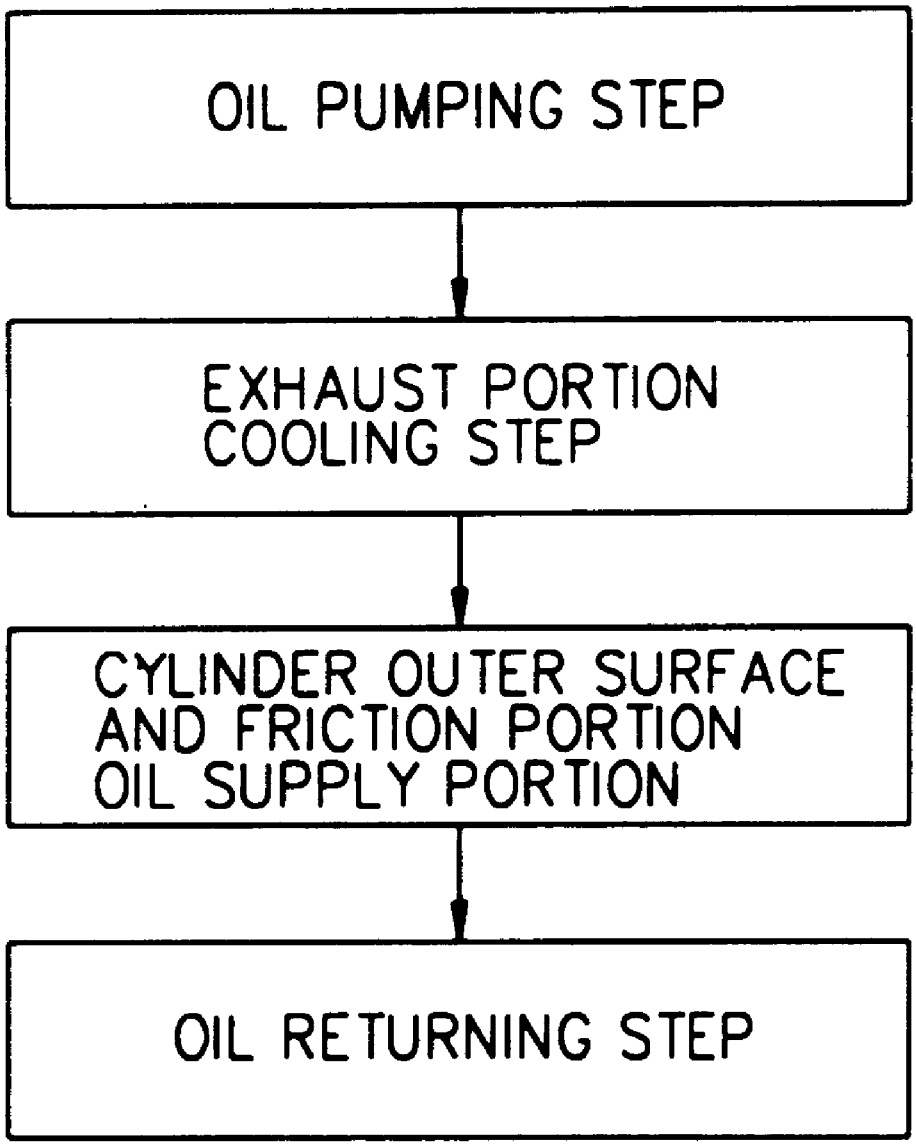
FIG. 13 is a flow chart illustrating an oil circulation process for a linear compressor according to a second embodiment of the present invention.

FIG. 9 is a partial cross-sectional view illustrating an oil circulation structure for a linear compressor according to a second embodiment of the present invention, FIG. 10 is a front view illustrating a frame having an oil circulation structure according to a second embodiment of the present invention, FIG. 11 is a cross-sectional view taken along line XI–XI' of FIG. 10, FIG. 12 is a cross-sectional view taken along line XII–XII' of FIG. 10, and FIG. 13 is a flow chart illustrating an oil circulation process for a linear compressor according to a second embodiment of the present invention.

The construction of the linear compressor according to a second embodiment of the present invention is similar with the construction according to the first embodiment of the present invention except for the oil circulation structure. Therefore, the oil circulation structure will be explained. The same elements as the first embodiment of the present invention are given the same reference numerals.

In the first embodiment of the oil circulation structure according to the present invention, the oil circulation is implemented by the following sequence: The oil pumping step→the cylinder outer surface and friction portion oil supply step→the exhaust portion cooling step→the oil returning step. In the second embodiment of the oil circulation structure according to the present invention, the oil circulation is implemented by the following sequence: The oil pumping step→the exhaust portion cooling step→the cylinder outer surface and friction portion oil supply step→the oil returning step.

In mode detail, as shown in FIGS. 9, 10, 11 and 12, when inserting the cylinder 200 into the hollow portion of the hollow cylindrical frame 400, a ring shape exhaust portion oil circulation path 300 is formed at an end portion due to a diameter difference between an inner diameter of the frame 400 and an outer diameter of the cylinder 200, and the valve cover 2 covers the open portion of the exhaust portion oil circulation path 300.

In addition, an oil suction path 410 is formed at a portion of the frame 400 for sucking an oil from the oil supply unit 10, and an oil introduction path 420 is formed to communicate the oil suction path 410 with the exhaust portion oil circulation path 300.

A through path 430 is formed at a hollow portion of the frame 400 and communicates with the upper portion of the exhaust portion oil circulation path 300. A cylinder cooling oil pocket 440 is formed at a hollow portion of the frame engaged with the cylinder 200 and has a certain width and depth, so that the oil introduced from the exhaust portion oil circulation path 300 and the through path 420 circulates on the outer surfaces of the cylinder 200.

Continuously, a friction portion lubricating oil pocket 75 is formed on the entire outer surfaces of the piston 70 engaged with the cylinder 200 and has a certain width and depth, and a plurality of oil through holes 210 are formed at the cylinder 200 to communicate with the friction portion lubricating oil pocket 75 and the cylinder cooling oil pocket 430.

In addition, an exhaust hole 450 is formed at an end portion of the frame 400 and communicates with the cylinder cooling oil pocket 430, so that the oil circulated in the cylinder cooling oil pocket 430 is flown into the inner bottom surface of the hermetic container 1.

A rectangular exhaust path 460 is formed at a portion of the frame 400 and has a certain width and depth corresponding to the diameter of the exhaust hole 450. An end portion of the same is submerged into the oil gathered in the interior of the hermetic container 1, so that the oil is returned from the exhaust hole 450 to the inner bottom surface of the hermetic container 1.

At this time, a rectangular exhaust path 460 is formed at a portion of the frame 400 and has a width and depth corresponding to the diameter of the exhaust hole 450. An end portion of the same is submerged into the oil in the interior of the hermetic container 1, so that the oil is returned from the exhaust hole 450 to the hermetic container 1.

The oil circulation operation of the linear compressor having an oil circulation structure according to the second embodiment of the present invention will be explained.

First, as the piston 70 reciprocates, when the oil supply unit 10 pumps the oil by the vibrations which occur during the gas compression process, the thusly pumped oil is introduced into the exhaust portion oil circulation path 300 via the oil suction path 410 and the oil introduction path 420.

The oil introduced into the exhaust portion oil circulation path 300 circulates along the oil circulation path 300 and firstly cools the heat generated at the exhaust portion and is introduced into the cylinder cooling oil pocket 440 via the communication path 430 and circulates in the oil pocket 440 for thereby cooling the cylinder 200. A part of the thusly pumped oil passes through the oil through hole 210 formed at the cylinder 200 and is introduced into the friction portion lubricating oil pocket 75 and performs a lubricating and cooling operation between the piston 70 and the cylinder 200. At this time, since the oil flown into the friction portion lubricating oil pocket 75 is flown via the oil circulation path 300 of the exhaust portion which has a higher temperature compared to the other portions, the oil viscosity is low for thereby implementing an excellent lubricating operation.

The oil flown into the friction portion cooling oil pocket 75 passes through the exhaust hole 450 and the exhaust path 460 via the oil through hole 210 and the cylinder cooling oil pocket 440 and is returned to the bottom surface of the hermetic container 1.

The sizes of the exhaust hole 450 and the exhaust path 460 are same, so that the oil flows along the exhaust path 460 and is returned to the bottom surface of the hermetic container 1 for thereby minimizing the flowing noises of the oil.

The oil returned to the hermetic container 1 radiates its heat to the outside via the hermetic container and becomes a low temperature state. The temperature-lowered oil circulates in the above-described manner.

In other words, in the oil circulation process according to the second embodiment of the present invention, as shown in FIG. 12, the step in which the oil is pumped from the oil supply unit 10 is performed. In the exhaust cooling step, the oil is supplied to the exhaust portion to which the gas is exhausted via the oil suction path 410 and the introduction path 420.

After the exhaust portion cooling step, the oil cools the outer surface of the cylinder 200, and in the cylinder outer surface and friction portion oil supply step, the oil lubricates and cools the friction portion of the cylinder 200 and the piston 70, and in the oil returning step, the oil is returned to the bottom surface of the hermetic container 1 via the exhaust hole 450 and the exhaust path 460.

In the second embodiment of the present invention, the suction path 410 and the exhaust path 460 may be formed of an additional pipe. In order to decrease the number of parts and the number of assemblies, the suction path 410 and the exhaust path 460 are formed at the frame 400. In another embodiment, the exhaust path 460 communicating with the exhaust hole 450 may not be formed. Namely, the oil may be dropped from the exhaust hole 450 for thereby implementing an oil returning process. In the present invention, the exhaust path 360 is formed to prevent the oil flowing noises.

In the oil circulation structure according to the second embodiment of the present invention, the oil having a lower temperature and gathered at the bottom surface of the hermetic container 1 is introduced into the high temperature exhaust portion for thereby effectively cooling the exhaust portion, so that an excellent cooling effect is implemented. In addition, since the high temperature oil passed through the exhaust portion is introduced into the friction portion, the viscosity of the oil is low for thereby implementing an excellent lubricating operation.

In the present invention, the oil is directed to cooling the heated exhaust portion and the friction portion which has a relatively lower temperature compared to the exhaust portion. Therefore, the cooling effect of the friction portion may be decreased. However, the present invention is basically designed to effectively and fully cool the friction portion as well as the heat generated by the motor.

As described above, in the oil circulation structure for a linear compressor and a method of the same, the cooling effect of the exhaust portion is good for thereby preventing a temperature increase of the gas. In addition, since the lubricating performance of the friction portion is excellent, it is possible to enhance the operation efficiency of the compressor by preventing the friction. The reliability of the products is enhanced by decreasing the flowing noises of the oil.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. In an oil circulation structure for a linear compressor including a compressor unit horizontally installed in the interior of a hermetic container in which an oil is provided a bottom surface and having an exhaust cover, a hollow cylindrical frame, a cylinder and a piston for compressing and exhausting a sucked gas, and an oil supply means mounted at an outer portion of the compressor unit for supplying an oil into the interior of the compressor unit, an oil circulation structure for a linear compressor, comprising:

an exhaust portion oil circulation path in which an oil is circulated at an exhaust portion at which a gas compression and exhausting operation is performed, for thereby cooling the exhaust portion;

a cylinder cooling oil circulation path communicating with one side of the exhaust portion oil circulation path for cooling an outer surface of the cylinder;

a friction portion cooling oil circulation path for cooling a friction portion between the cylinder and the piston;

a plurality of oil through holes formed at the cylinder for communicating the cylinder cooling oil circulation path with the friction portion cooling oil circulation path;

an oil supply path for supplying the oil pumped from the oil supply means into the exhaust portion oil circulation path; and an oil exhaust path communicating with the cylinder cooling oil circulation path and formed at the frame for returning the oil into the bottom surface of the hermetic container.

2. The structure of claim 1, wherein said exhaust portion oil circulation path has its ring shape end portion formed due to a diameter difference between an inner diameter of the frame and an outer diameter of the cylinder, and an open portion covered by the valve cover.

3. The structure of claim 1, wherein said cylinder cooling oil circulation path is formed of a cylinder cooling oil pocket of a spacious portion at a hollow surface of the frame engaged with the cylinder and having a certain width and depth.

4. The structure of claim 3, wherein said cylinder cooling oil pocket is formed on the entire hollow surfaces of the frame.

5. The structure of claim 1, wherein said oil supply path includes:

an oil suction path formed to have a certain depth and length at one side surface of the frame and communicating with the oil supply means; and an oil introduction path for communicating the oil suction path with the exhaust portion oil circulation path.

6. The structure of claim 1, wherein said oil exhaust path includes:

an oil exhaust path formed at one side surface of the frame and having a certain width and depth; and an exhaust hole formed at the frame for communicating the oil exhaust path with the cylinder cooling oil circulation path.

7. The structure of claim 6, wherein one end of the oil exhaust path is submerged into the oil gathered at the bottom surface of the hermetic container.

8. The structure of claim 6, wherein said oil exhaust path is formed parallely to the oil suction path of the oil supply path formed at the frame.

9. The structure of claim 6, wherein said oil exhaust path has an open portion and is formed in a rectangular cross section shape having a certain width and depth corresponding to the diameter of the exhaust hole, so that the oil flows from the exhaust hole to the bottom surface of the hermetic container.

10. In an oil circulation method for a linear compressor including a compressor unit horizontally installed in the interior of a hermetic container and having a cylindrical frame, a cylinder and a piston for compressing and exhausting a sucked gas, and an oil supply means mounted at an outer portion of the compressor unit for thereby supplying an oil into the compressor unit by the oil supply means, an oil circulation method for a linear compressor, comprising:

an oil pumping step for pumping an oil gathered on a bottom surface of a hermetic container by the oil supply means;

an exhaust portion cooling step for cooling the exhaust portion in a circulation manner when the oil pumped in the oil pumping step is flown to the side of the exhaust portion through which the gas is exhausted;

a friction portion oil supply step for lubricating and cooling the friction portion when the oil after the exhaust portion cooling step is flown to the friction portion between the cylinder and the piston; and an oil returning step in which the oil after the friction portion oil supply step is returned to the bottom surface of the hermetic container.

11. The method of claim 10, wherein the oil after the friction portion oil supply step flows along an outer surface of the cylinder for thereby cooling the cylinder and lubricates and cools the friction portion between the cylinder and the piston.

* * * * *